US011255536B2

(12) United States Patent
Kaiser et al.

(10) Patent No.: US 11,255,536 B2
(45) Date of Patent: Feb. 22, 2022

(54) BURNING LAMP, IN PARTICULAR WIND LIGHT AND SUSPENSION THERETO

(71) Applicants: Thomas Kaiser, Schrattenbach (DE); Christian Wassermann, Kraftisried (DE)

(72) Inventors: Thomas Kaiser, Schrattenbach (DE); Christian Wassermann, Kraftisried (DE)

( * ) Notice: Subject to any disclaimer, the term of this patent is extended or adjusted under 35 U.S.C. 154(b) by 0 days.

(21) Appl. No.: 16/647,183

(22) PCT Filed: Sep. 13, 2018

(86) PCT No.: PCT/EP2018/000432
§ 371 (c)(1),
(2) Date: Apr. 7, 2021

(87) PCT Pub. No.: WO2019/052683
PCT Pub. Date: Mar. 21, 2019

(65) Prior Publication Data

US 2021/0222869 A1 Jul. 22, 2021

(30) Foreign Application Priority Data

Sep. 13, 2017 (DE) ..... 202017004777.2

(51) Int. Cl.
*F21V 35/00* (2006.01)
*F21S 13/12* (2006.01)
*F21V 37/00* (2006.01)

(52) U.S. Cl.
CPC ..... *F21V 35/003* (2013.01); *F21S 13/12* (2013.01); *F21V 37/00* (2013.01)

(58) Field of Classification Search
CPC .... F21V 35/00; F21V 35/003; F21V 37/0016; F21V 37/0058; F21V 37/0095
See application file for complete search history.

(56) References Cited

U.S. PATENT DOCUMENTS 5,690,420 A 11/1997 Saldana
7,175,298 B2 * 2/2007 Schou ..... F21L 19/00 362/161

(Continued)

FOREIGN PATENT DOCUMENTS

DE 9416788 U1 12/1994
FR 388023 A 7/1908
WO 2017025192 A1 2/2017

*Primary Examiner* — Mariceli Santiago
(74) *Attorney, Agent, or Firm* — Endurance Law Group PLC

(57) ABSTRACT

The aim of the invention is to comfortably handle a combustion light, in particular in the form of a wind light, comprising a firing agent, preferably a wax candle, a base (3), and a preferably translucent housing part (2), and a carrier tray (4) for the firing agent. This aim is achieved, according to the invention, in that the carrier tray (4) is mounted on a cardanic suspension (5) about two axes (5*b*-5*b*; 5*c*-5*c*) in an overhead pivotable manner. The invention further relates to a suspension having a lower part, wherein the cardanic suspension (5) is pivotable about the two pivot axes thereof by more than 90°, in particular by 180°, wherein in said pivot position, the upper housing part (2) is arranged below as a base, and the lower part (3) is then positioned on the top as a covering.

18 Claims, 2 Drawing Sheets

(56) References Cited

U.S. PATENT DOCUMENTS

| | | | | |
|---|---|---|---|---|
| 2005/0242100 | A1* | 11/2005 | Shepard | A01K 5/0135 220/603 |
| 2006/0033674 | A1* | 2/2006 | Essig | C02F 1/14 343/912 |
| 2007/0256955 | A1 | 11/2007 | Hume | |
| 2007/0272695 | A1 | 11/2007 | Shepard | |
| 2008/0265505 | A1* | 10/2008 | DeRuyter | A63F 9/0413 273/146 |
| 2011/0200956 | A1 | 8/2011 | Franklin | |
| 2018/0279828 | A1* | 10/2018 | Kaiser | F23Q 25/00 |

* cited by examiner

BURNING LAMP, IN PARTICULAR WIND LIGHT AND SUSPENSION THERETO

BACKGROUND OF THE INVENTION

The invention relates to a burning lamp, in particular a wind light, with the features in the preamble of claim 1, as well as a corresponding suspension with various uses.

Such burning lamps are often used in outdoor areas (garden, terrace, etc.) for decorative lighting at a garden party. In order to achieve a stable flame, even in stronger winds, such burning lamps usually have a glass housing. A wind light made of stainless steel and glass is known from DE 94 16 788 U1. The description there states that "burning lamps have been known for millennia", e.g. in churches, where wax or oil is used as burning material. To light them, however, the glass tube, which serves as a wind protection and is open at the top, usually has to be removed from the base (base part) in order to reach the wick easily. This is also often necessary to extinguish the flame. When using such wind lights outdoors, the problem arises that the wick of the fuel is soaked through by rain, so that re-lighting is hardly possible.

In WO 2017/025192 (of the applicants) a tea light is described which can be turned "overhead" just like a fire basket. The burning material in a tray performs this tilting by 180° in an unchanged horizontal position, so that the flame then hits a (closed) bottom and is then quickly extinguished due to lack of air. This principle can also be applied to floor lamps or hanging lamps, wherein the lamp housing is turned upside down to extinguish the flame, but the tray, which is mounted on an axis, remains horizontal. The swiveling or tilting movement should thus be exactly parallel to one side edge of the (preferably cubic) housing. In this disclosure it is stated that the swiveling around this one axis cannot always be exactly maintained with cylindrical basic shapes, so that the oil (as burning agent) should only be filled up to half the filling level of the support tray to avoid spillage. However, this precaution (only half the filling level) considerably reduces the burning time for given dimensions of the burning lamp.

Therefore, a burning lamp is to be developed which improves the burning time and is comfortable to use. In addition, an "overhead" pivotable suspension for various applications is to be described, which allows pivoting in all directions, i.e. independently of a side edge.

BRIEF SUMMARY OF THE INVENTION

This task is solved by the features of claim 1. Advantageous embodiments are subject of the subclaims. The abovementioned suspension for various appliances, in particular household articles, is subject of claim 13.

The proposed burning lamp can be manufactured from few components, in particular with a (hollow) glass cylinder as translucent housing part for wind protection outdoors and a base as well as a support tray for pivotable mounting of a burning agent, e.g. a candle. However, a sheet metal tube open at the end face can also be used as a translucent housing part, the outer casing of which has many slits or openings. However, company logos etc. can also be punched or cut in to achieve the desired light transmission to illuminate the surroundings.

The pivotable mounting of the support tray on a gimbal suspension (Cardan suspension) allows complete mobility around two axes (preferably extending perpendicular to each other), so that users no longer have to pay attention to the tilting direction parallel to one axis, but can tilt the burning lamp in any direction and turn it "upside down". After tilting, the support tray is almost completely encased and the flame of the burning agent is smothered. Even if the edge gaps are not 100% sealed, the carbon monoxide that is still produced will sink to the bottom and thus cut off the air supply to the burning agent. A further advantage over the usual manual pinching of the wick is that the wick is not touched or bent during the above smothering, so that re-lighting (e.g. the next day) is easier, i.e. the burning agent can be completely used up.

This main advantage of tilting around any edge, preferably by 180° ("overhead"), can also be applied to other household articles such as a sugar bowl, since besides the usual use position with good access to the sugar supply, it is important that in the storage position the sugar supply is largely protected against moisture. By simply tilting, as explained on the wind light, the base part can become the top cover and thus cover the sugar supply in the support tray. As the support tray, here with the sugar supply, remains in the horizontal position during each tilting movement, spillage is excluded.

Similar advantages apply to jewelry boxes (pieces of jewelry are invisible after swiveling, but unchanged in their position) or trays in gastronomy, e.g. to protect food from heat loss, but then to make the respective food easily accessible to the guest by simply turning the housing. An ashtray equipped with such a gimbal suspension is also conceivable, whereby after swiveling by at least 90°, preferably 180°, a certain odor seal is achieved (in addition to the extinguishing effect described above). Advertising articles are also conceivable, whereby in the basic position e.g. an emblem of a company or a club mounted on the support tray or gimbal suspension is visible, but this virtually disappears or is invisible after swiveling into the upside down position.

BRIEF DESCRIPTION OF THE SEVERAL VIEWS OF THE DRAWINGS

Further advantages of the invention result from the following description of an exemplary embodiment based on the drawings. The figures show.

DETAILED DESCRIPTION OF THE INVENTION

Figure 1:
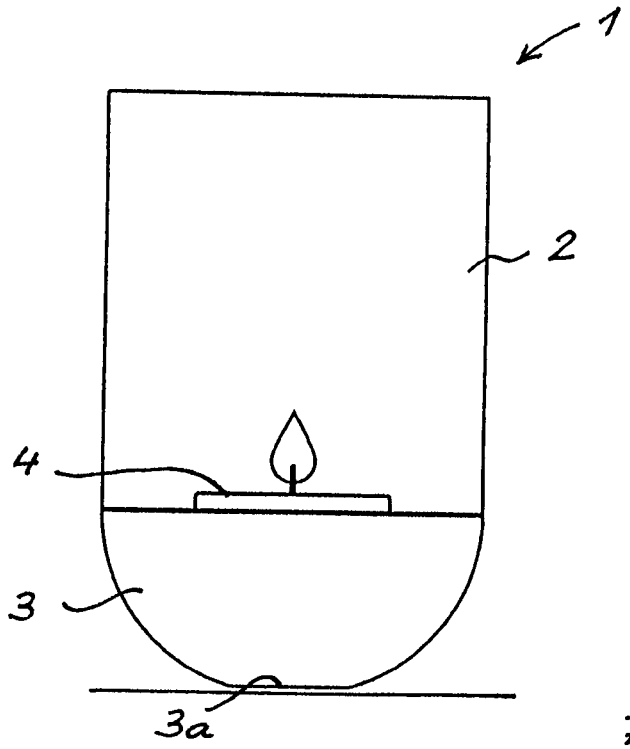
FIG. 1: a representation of a burning lamp in operating position.

FIG. 1 shows a burning lamp 1, in particular in the form of a wind light, with a base 3 and a translucent housing part 2 placed on it, and with a support tray 4 (for a burning agent). The burning agent is preferably a wax candle whose wick is lit here, as schematically indicated by a flame. As described below, the support tray 4 is pivotable by means of a gimbal suspension 5 relative to the housing part 2 and also to the hemispherical base 3 about two axes (5*b*-5*b*; 5*c*-5*c*), each formed by two correspondingly coaxial pins. Such a construction is also useful for food containers, in which case the support tray 4 contains e.g. a sugar supply (or a variable fragrance dispenser).

Figure 2:
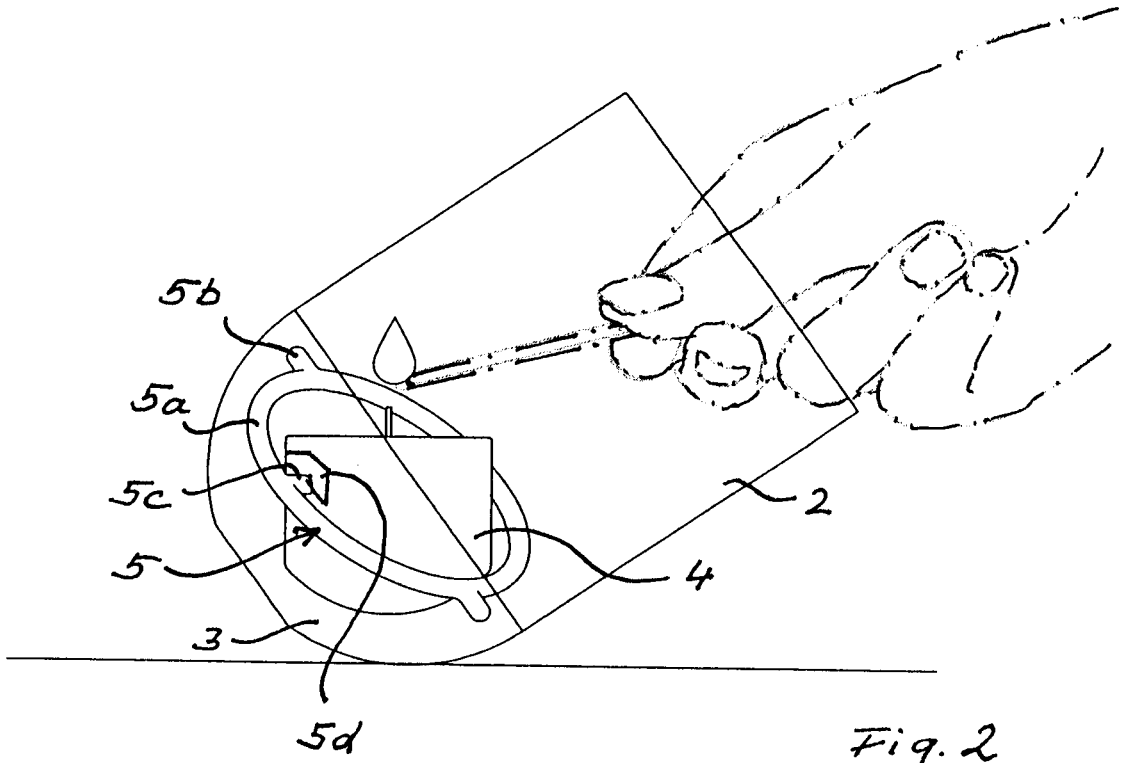
FIG. 2: the burning lamp according to FIG. 1 during the lighting process.

As shown in FIG. 2 (and the other figures), on ring 5*a*, two pins 5*b* are directed radially outward and two pins 5*c* are directed radially inward towards support tray 4. Therefore, the support tray 4 can move in two dimensions, i.e. it has two so-called degrees of freedom, so that the support tray 4 always remains exactly aligned in its horizontal plane regardless of the inclination of the burning lamp 1 and thus no burning agent (e.g. oil) can leak out. The base 3 has a substantially hemispherical outer shape, so that the burning lamp 1 can simply be tilted into the lighting position shown here (and also remains stable in this position), in order to light the burning agent with a match, as shown here in dashed/dotted lines. Tilting the lamp to almost any inclination is particularly advantageous when lighting the lamp, as the wick of the burning agent is often relatively flat and the burning lamp 1 can therefore be tilted preferably in this direction in order to reach the wick easily with a match within the usually rather narrow glass tube. The good accessibility also applies to a sugar bowl, for example, where a teaspoon is used instead of a match to access the sugar supply in the support tray 4. The tray itself remains in a horizontal position in every tilting direction, so that the sugar supply is easily accessible, but in the "upside down" position (see FIG. 5) it is hygienically covered.

Figure 3:
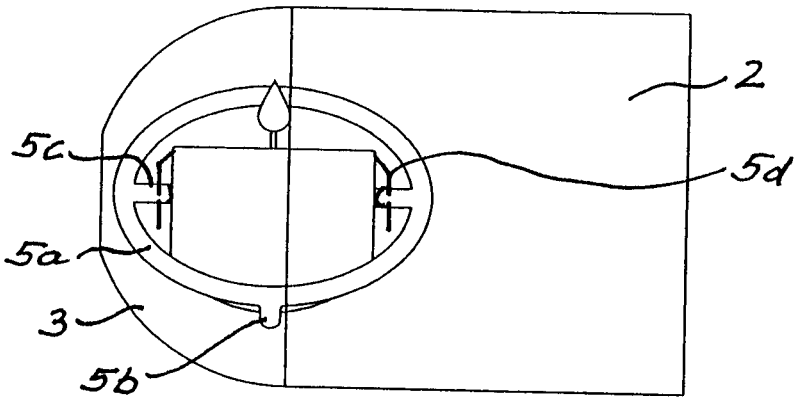
FIG. 3: a burning lamp tilted by 90° to the horizontal.
Figure 4:
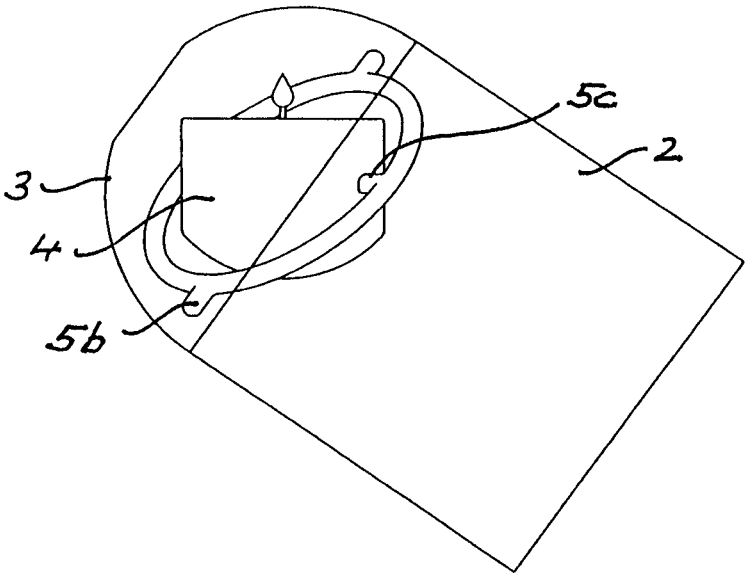
FIG. 4: an even further tilted view of the burning lamp.

Although the burning lamp 1 is inherently stable in the tilted position as shown in FIG. 2 in this position, the lower end 3*a* of the hemispherical base 3 is preferably flattened as a standing surface to increase stability in the normal operating position as shown in FIG. 1. In FIG. 2, adjacent to pin 5*c* a clip-shaped holder 5*d* (see also FIG. 3) is indicated, which is open towards the bottom for plugging the support tray 4 onto the two inwardly directed pins 5*c*. In FIGS. 3 and 4 the burning lamp 1 is shown in strongly tilted positions, namely in the horizontal position (FIG. 3) and tilted by another 45°. This shows that the support tray 4 inside the Cardan ring (gimbal ring) 5*a* always remains in horizontal position. The Cardan ring 5*a* is preferably configured with the four pins 5*b*, 5*c* as a metal casting in order to achieve high stability and cost-effective production.

Figure 5:
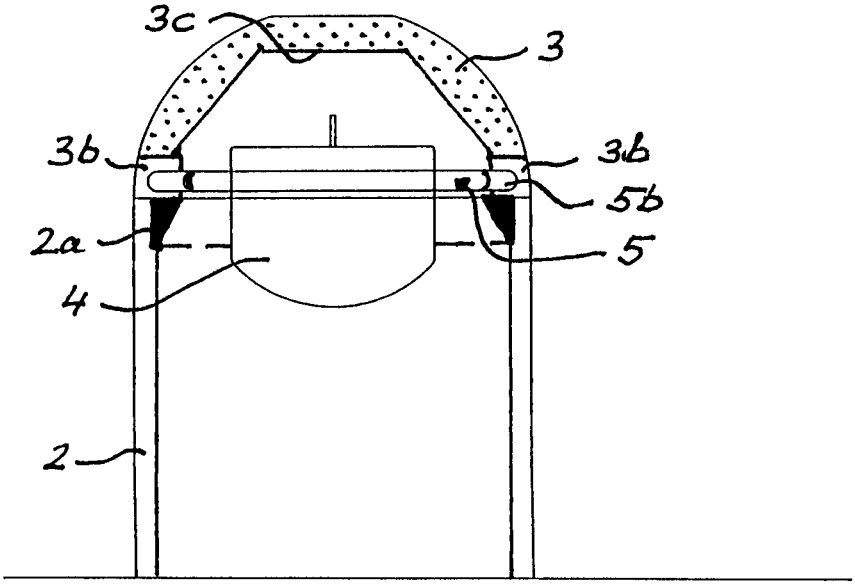
FIG. 5: a partially cut view in overhead extinguishing position.

FIG. 5 shows the burning lamp 1 in its overhead extinguishing position. The base 3 is here cut in its central plane along its main extension, whereby a vaulted shape or cavity 3*c* is visible. Since the flame is still burning at the transition from FIG. 4 to FIG. 5, the base 3 or at least its cavity 3*c* is made of a temperature-resistant material, namely metal or ceramic, as shown dotted here. At the transition between base 3 and the housing part 2 below, two opposite slots 3*b* are further visible, into which the pins 5*b*, which project outwards, are inserted when components 2 and 3 are separated from each other. The slots 3*b* are aligned parallel to the main extension of the burning lamp 1 and are adjacent to an (here upper) end face of the translucent housing part 2, so that the pins 5*b* are mounted therein to form one of the two degrees of freedom of the gimbal suspension 5.

For easy fixation between base 3 and the translucent housing part 2, in particular a hollow glass cylinder, a connecting sleeve 2*a* can be inserted, which creates an annular coupling zone (shown here blackened) between the components 2 and 3. The connecting sleeve 2*a* can also have a thread, a bayonet lock or similar positive and/or frictional coupling elements, and can also be connected to base 3 in one piece. As known per se, the burning lamp 1 can be designed in the manner of a floor lamp or hanging lamp. What is new, however, is that the burning lamp 1 can be mounted on a rod with a simple upper recess without the need for any further attachments, due to its inherent stability as described above (see FIG. 2). Such a rod is preferably an earth spike, so that the burning lamp 1 can be positioned especially at a height of e.g. 80 cm in the garden for better illumination. The support tray 4 is filled with fuel, e.g. oil or wax, whereby fragrances can also be provided.

All in all, this results in an attractive lighting with long burning time and safe, comfortable handling of the burning lamp 1, which can of course also be used indoors as a table lamp etc. Here, too, the advantage of safe, easy extinguishing of the flame through the "overhead" rotation, with practically any tilting direction due to the Cardan bearing, can advantageously be used, as can the convenient lighting.

The same applies to the independently claimed suspension in a lower part, in particular a base and an upper housing part, wherein the gimbal suspension 5 is pivotable by 180° about its two pivot axes, so that the initially upper (in FIG. 1) housing part 2 is arranged in this pivoted position as the base at the bottom and the original lower part 3 is then arranged as a cover at the top, as shown in FIG. 5. This suspension can preferably be used for food containers, such as a sugar bowl, for a jewelry box or an ashtray. It can also be used in a gastronomic tray (to keep food warm) or in an advertising article, in particular with an emblem which is visible in one position (see FIG. 1) with the lower part (base 3) as base and covered in the pivoted position with the lower part as the cover. In this way, surprise effects can be achieved for the person looking at it.

It should be pointed out that such (gimbal) suspensions are known to be used in levelling devices, cameras and the like; there, however, the gimbal only serves to compensate for a few degrees of inclination, while the suspension claimed here, in conjunction with the lower part, support tray and upper part, performs a pivoting movement of (about) 180° in order to achieve covering of the product located in support tray 4, whether it is a candle to extinguish it or a sugar supply to protect it from flies, for example. The same applies to an ashtray (with odor barrier) or a jewelry box (visibility cover). Preferably, each of the upper and lower parts has a hemispherical outer shape, with gimbal suspension 5 inserted in the central area.

The invention claimed is:

1. A method for storing an object or material in a support tray of a burning lamp, the burning lamp comprising a base, a housing part and a support tray, wherein the support tray is pivotable relative to the housing part and the support tray is mounted on a gimbal suspension about two axes, the gimbal is pivotable about its two pivot axes by 180°, wherein for storage purposes the housing part is arranged at the bottom and the base is arranged as a cover at the top, so that the base is an upper cover for the support tray, and wherein the base is formed as a metal or ceramic part and has a vaulted cavity in the interior.

2. The method according to claim 1, wherein the housing part is translucent.

3. The method according to claim 2, wherein the housing part is a glass cylinder.

4. The method according to claim 1, wherein the gimbal suspension is formed as a ring with four pins, wherein two of the pins are oriented radially outwards and two of the pins are oriented radially inwards, wherein the outwardly projecting pins are inserted into two opposite slots of the base, wherein the slots are aligned parallel to the main extension of the burning lamp, and wherein the slots are adjacent to an end face of the housing part.

5. A burning lamp with a base, a housing part and with a support tray for a burning agent, wherein the support tray is pivotable relative to the housing part, wherein the support tray is mounted on a gimbal suspension so as to be pivotable overhead about two axes, wherein the base has a largely hemispherical outer shape and the lower end of the hemispherical base is flattened as a standing surface, and wherein the base has a vault-shaped cavity in the interior.

6. The burning lamp according to claim 5, wherein the housing part is translucent.

7. The burning lamp according to claim 5, wherein the base is formed as a metal or ceramic part.

8. The burning lamp according to claim 5, wherein the gimbal suspension is formed as a ring with four pins, wherein two of the pins are oriented radially outwards and two of the pins are oriented radially inwards.

9. The burning lamp according to claim 8, wherein the outwardly projecting pins are inserted into two opposite slots of the base, wherein the slots are aligned parallel to the main extension of the burning lamp.

10. The burning lamp according to claim 9, wherein the slots are adjacent to an end face of the housing part.

11. The burning lamp according to claim 5, wherein a connecting sleeve is inserted between the base and the housing part.

12. The burning lamp according to claim 5, wherein oil or wax is filled in the support tray as a burning agent, wherein a wick is provided for lighting.

13. The burning lamp according to claim 5, wherein two clip-shaped holders are provided on the outside of the support tray for fitting onto the inwardly directed pins.

14. The burning lamp according to claim 5, wherein an emblem is visible on the support tray or on a ring of the gimbal suspension when the base is located at the bottom and the housing part is located at the top and wherein the emblem is not visible when the housing part is located at the bottom and the base is located at the top as a cover.

15. The burning lamp according to claim 5, wherein the burning lamp is dimensioned such that the burning lamp can be tilted into a lightning position in order to be able to light the burning agent with a match when there is a burning agent in the support tray.

16. A burning lamp with a base, a housing part and with a support tray for a burning agent, wherein the support tray is pivotable relative to the housing part, wherein the support tray is mounted on a gimbal suspension so as to be pivotable overhead about two axes, wherein the base has a largely hemispherical outer shape and the lower end of the hemispherical base is flattened as a standing surface, and wherein a connecting sleeve is inserted between the base and the housing part.

17. A burning lamp with a base, a housing part and with a support tray for a burning agent, wherein the support tray is pivotable relative to the housing part, wherein the support tray is mounted on a gimbal suspension so as to be pivotable overhead about two axes, wherein the base has a largely hemispherical outer shape and the lower end of the hemispherical base is flattened as a standing surface, and wherein two clip-shaped holders are provided on the outside of the support tray for fitting onto the inwardly directed pins.

18. A burning lamp with a base, a housing part and with a support tray for a burning agent, wherein the support tray is pivotable relative to the housing part, wherein the support tray is mounted on a gimbal suspension so as to be pivotable overhead about two axes, wherein the base has a largely hemispherical outer shape and the lower end of the hemispherical base is flattened as a standing surface, and wherein an emblem is visible on the support tray or on a ring of the gimbal suspension when the base is located at the bottom and the housing part is located at the top and wherein the emblem is not visible when the housing part is located at the bottom and the base is located at the top as a cover.

* * * * *